United States Patent [19]

Liou

[11] Patent Number: 4,937,979

[45] Date of Patent: Jul. 3, 1990

[54] UPPER AND LOWER SLIDING MECHANISMS FOR SHOWCASES

[76] Inventor: Chih C. Liou, 2Fl., NO. 4, Lane 767, Ming Sheng E. Road, Taipei, Taiwan

[21] Appl. No.: 422,411

[22] Filed: Oct. 16, 1989

[51] Int. Cl.[5] ..... E05D 13/00

[52] U.S. Cl. ..... 49/449; 49/404; 70/99

[58] Field of Search ..... 49/404, 425, 449, 450; 70/90, 99, 100

[56] References Cited

U.S. PATENT DOCUMENTS

| | | | |
|---|---|---|---|
| 3,479,769 | 11/1969 | Diack | 49/449 |
| 3,956,911 | 5/1976 | Corboud | 70/100 |
| 4,192,100 | 3/1980 | Klema | 49/404 |
| 4,594,813 | 6/1986 | Sterner, Jr. | 49/450 |
| 4,809,525 | 3/1989 | Cox | 70/100 |

*Primary Examiner*—Gary L. Smith
*Assistant Examiner*—Jerry Redman
*Attorney, Agent, or Firm*—Notaro & Michalos

[57] ABSTRACT

The present invention relates to an upper and a lower sliding mechanisms as well as an upper rail and a lower rail structures for showcases, wherein the lower rail structure has two rail grooves with wider and shallower profile than usual rail for the same purposes and on which wheels mounted on the lower sliding mechanism can freely roll; and the lower sliding mechanism is equipped with a wheel lock having a stop section which may be extended outward and retracted inward by using a key to respectively form a stable locking condition and an unlocking condition for the showcases. The upper rail structure has a substantially M-shaped cross section, and two rail channels are formed at each side of a middle recess. In the upper sliding mechanism, two n-shaped insert channels are respectively disposed in the two rail channels to fitly receive glass sheets for showcases. A plurality of wheels are set on the top faces of the insert channels in such a manner that the wheels interchangedly contact left and right inner wall surfaces of the rail channels and can freely roll thereon, whereby no swing and noise will occur during pulling or pushing the glasses.

1 Claim, 7 Drawing Sheets

UPPER AND LOWER SLIDING MECHANISMS FOR SHOWCASES

BACKGROUND OF THE INVENTION

The present invention relates to upper and lower sliding mechanisms for showcases, which are characterized by the fact that a window glass can be stably and smoothly slided without swinging and can be easily safety locked.

As well known, a showcase is used to display articles or the like and can be often seen in department stores or general commercial stores or other public places. However, it happens that when pulling the glass of conventional showcases for accessing articles placed therein, the glass always swings and makes noise and can not be steadily operated. Furthermore, the saw-toothed lock usually used with showcases often gets loose and oblique due to vibration after a period of use, and thus requires adjustment. Therefore, a user always feels inconvenient and bored.

The above-mentioned drawbacks occur for the following reasons:

1. The conventional aluminum lower rail of a showcase is formed with two rail projections 81, as shown in FIG. 8, and the wheel 90 is formed with a lower inward curved surface 91 corresponding to the rail projection 81 so as to roll thereon, wherein the glass 8*a* or 8*b* is not closely mounted on the wheel 90 and therefore, when pulled, the glass tends to swing and make noise, and, after worn by the contact with rail for a long time, the wheel will be deformed to deteriorate the stability of rolling and make even louder noise.

As shown in FIG. 10, a conventional aluminum upper rail of a showcase includes a channel bar with substantially M-shaped cross-section, wherein two channels 77 are formed at each side of an intermediated partition 66 for slidably receiving the upper edge of glasses 8*a* and 8*b*. It can be seen that the glasses 8*a* and 8*b* are not closely fitted into the channel 77 and thereby when pulled or slided, the glasses are easy to swing, make noise and have poor stability.

As shown in FIG. 9, a conventional saw-toothed lock 1 includes a long and flat saw-toothed bar 4 having a n-shaped end 2 to secure a glass thereto with a fastening belt 3. A locking member 5 having a front stopper 6 is slidably mounted on the sawtoothed flat bar 4. A key can be inserted into a key hole 7 of the locking member 5 to disengage with and slide along the saw-toothed flat bar 4. When the stopper 6 is locked, then the other piece of glass may be prevented from moving. When the locking member 5 is slided out of the saw-toothed flat bar 4, the other glass is released from locking, accordingly, and can be pulled open again. However, the fastening bolt 3 often gets loose after several vibrations, making whole saw-toothed lock 1 loose and oblique and therefore require refastening. As a result, quite many troubles are added to the users.

SUMMARY OF THE INVENTION

It is therefore a primary object of the present invention to provide an upper sliding mechanism and a lower sliding mechanism for showcase which can make the window glass to be operated stably without swinging movement.

It is a further object of the present invention to provide an upper sliding mechanism and a lower sliding mechanism for showcase which can be easily locked and unlocked by a wheel lock disposed on the lower sliding mechanism to eliminate the drawbacks existing in prior art.

The present invention can be best understood via the following description and accompanying drawings wherein:

DETAILED DESCRIPTION OF THE PREFERRED EMBODIMENT

Figure 1:
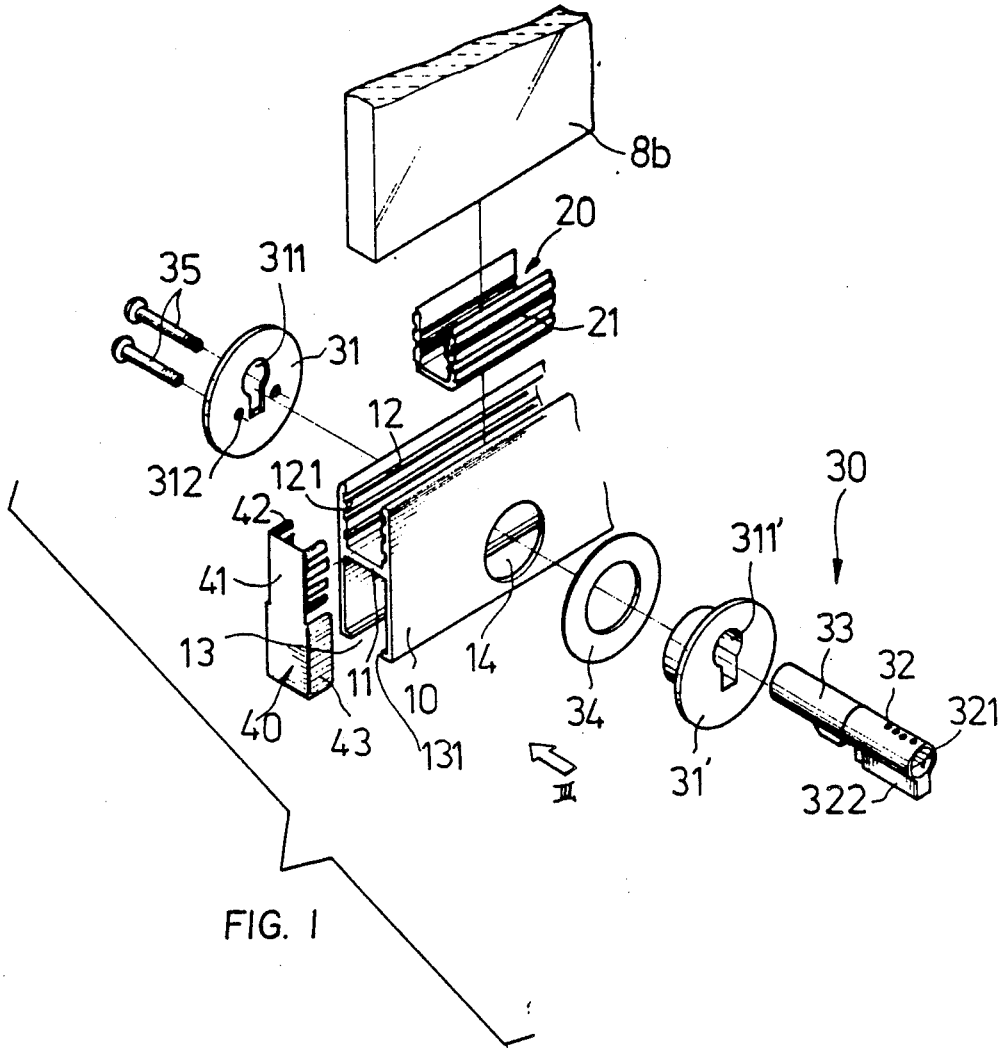
FIG. 1 is a perspective exploded view of a lower sliding mechanism and a lock of the present invention.

Please refer to FIGS. 1, 2, 5 and 6. The present invention includes a lower rail 50, a lower sliding mechanism 10 equipped with lock 30, an upper rail 70, and an upper sliding mechanism composed of a plurality of wheels 75, channels 74, and inner plastic members 76.

The lower sliding mechanism 10 has a horizontal middle partition 11 whereby an upper groove 12 and lower groove 13 are respectively formed above and below the middle partition 11. A plurality of equally-spaced and longitudinally extending projections 121 are formed on the inside walls of the upper groove 12, and two inwardly extending flanges 131 are formed at the lower ends of the lower groove 13. Two circular holes 14 are formed seperately on the outer surfaces of the two side walls of the lower groove 13.

Moreover, inside the upper groove 12 is fitted with a plastic U-shaped member 20, the outer surfaces of two vertical side walls of which are formed with longitudinally extending projections 21 corresponding to the recesses between the projections 121 on the upper groove 12. The U-shaped member 20 is associated with the upper groove 12 with its projections 21 fitly engaged with the recesses formed between the projections 121. Disposed at one end of the lower sliding mechanism 10 is a cover member 40, an upper portion 41 of which is formed with a plurality of projections 42 corresponding to the recesses formed between projections 121, whereby the cover member 40 can be fitted to the lower sliding mechanism 10 with the projections 42 engaged with the recesses between the projections 121. On the lower portion of the cover member 40, two side portions 43 are formed to be suitably located on the inward extending flanges 131 of the lower groove 13 when the cover member 40 is associated therewith.

Additionally, the wheel lock 30 of the present invention includes two key hole surface rings 31, 31', a rotary section 32 and a stop section 33, as shown in FIG. 1. The key hole surface rings 31, 31', are disposed respectively on two outer sides of the lower groove 13 corresponding to the two circular holes 14 formed thereof. The ring 31 has a key hole 311 and two bolt holes 312 through which two bolts 35 are put to fasten the ring 31 to the ring 31'. A washer 34 is provided to enhance the fastening thereof. The rotary section 32 and stop section 33 are coaxially associated, wherein the rotary section 32 has a restricting block 322 and a key hole 321 into which a key can be inserted to rotate the rotary section 32. The rotary section 32 extends through a key hole 311' formed on the ring 31', and further through the circular hole 14 as well as the key hole 311 on the ring 31 with the stop section 33 protruding therebeyond, whereby by means of rotating the rotary section 32, the same and the stop section 33 can be pulled out therefrom or pushed thereinto when the restricting block 322 is aligned with the key holes 311 and 311'; and, when the restricting block 32 does not match with the key holes 311 and 311', with the rotary section 32 located in the lower groove 13 and the stop section 33 protruding beyond the key hole ring 31, glass 8a is prevented from moving due to the restricting effect of the stop section 33, as shown in FIG. 2.

Figure 2:
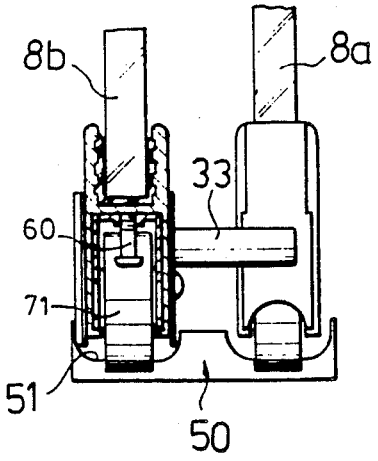
FIG. 2 is a side cross-sectional view of the lower sliding mechanism of the present invention.

Now referring to FIG. 2, the lower rail 50 of the present invention has two parallel rail grooves 51 which have wider and shallower profile. A wheel 71 is secured to the lower sliding mechanism 10 within the lower groove 13 by a screw 60 in a manner that the wheel 71 is capable of rolling on the rail groove 51. Since the rail groove 51 has a wider and shallower profile, the wheel 71 can roll thereon with better stability and less wearing produced.

Figure 3A:
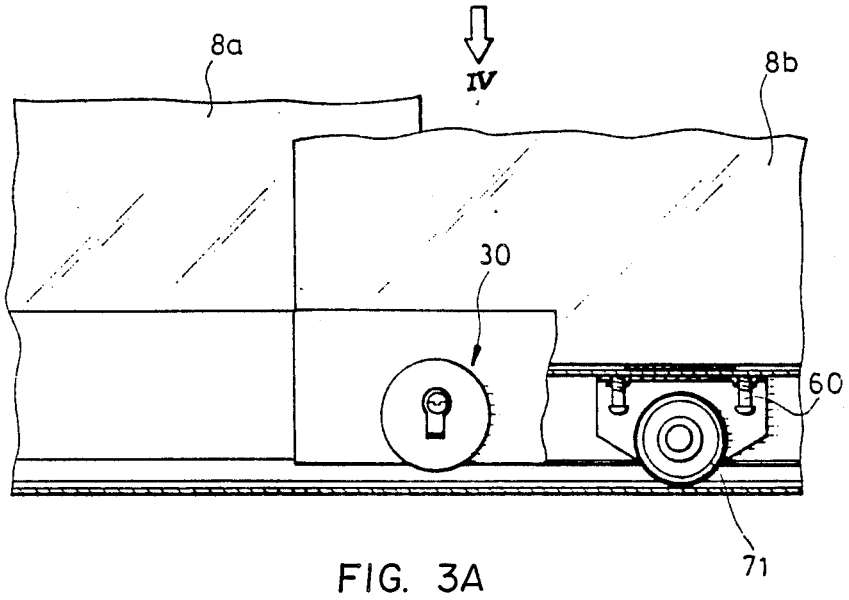
FIG. 3 (A) is a partial front view of the present invention showing the window glass sheets in a locked condition.
FIG. 3(B) is also a partial front view of the present invention showing the glass sheets in an unlocked condition.
Figure 4A:
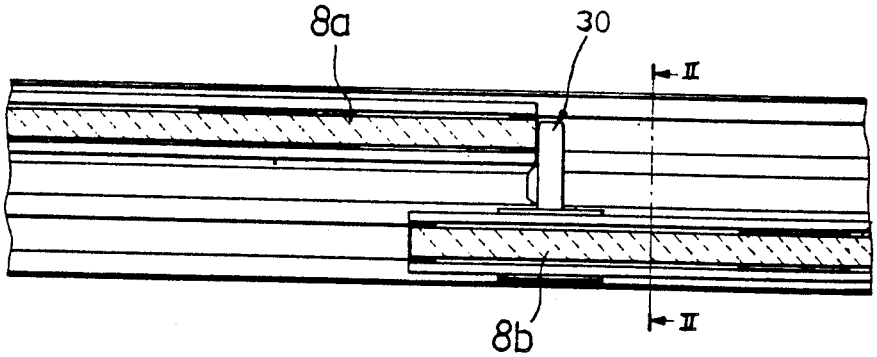
FIG. 4(A) is a partial top cross-sectional view of the present invention showing the glass sheet in a locked condition.
Figure 3B:
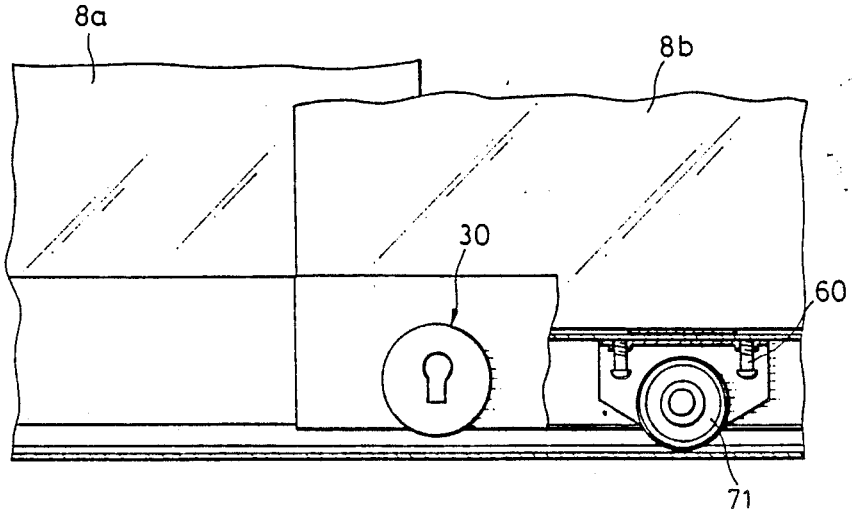
Figure 4B:
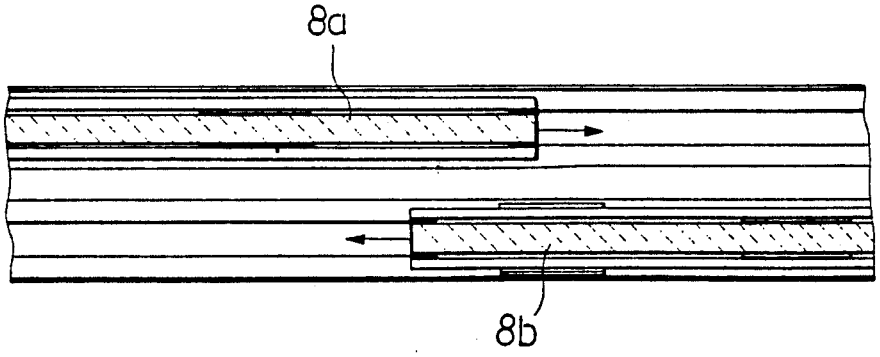
FIG. 4(B) is a partial top cross-sectional view of the present invention showing the glass sheet in an unlocked condition.
Figure 5:
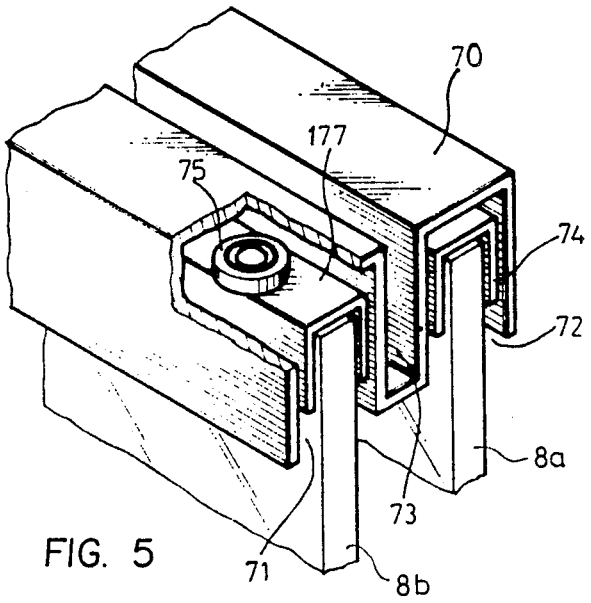
FIG. 5 is a partially fragmental perspective view of the upper rail of the present invention.
Figure 6:
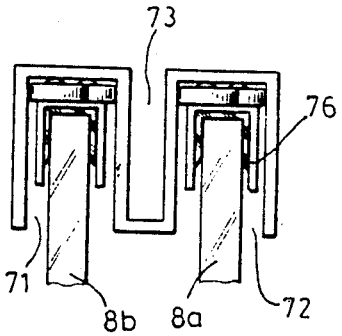
FIG. 6 is a side cross-sectional view according to FIG. 5 showing the relation between the upper rail and the upper sliding mechanism of the present invention.
Figure 7:
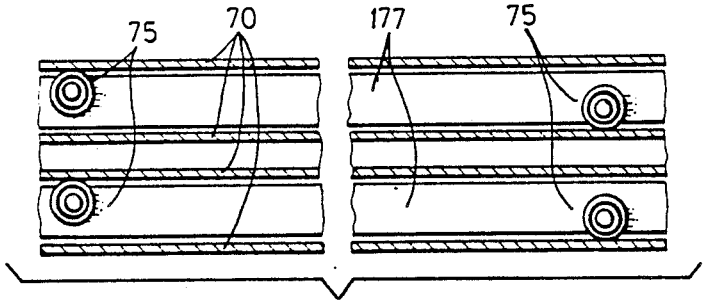
FIG. 7 is a partially top cross-sectional view according to FIG. 5 showing the disposition of the upper sliding mechanisms of the present invention.
Figure 8:
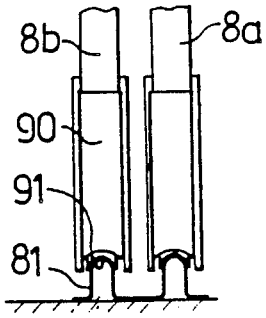
FIG. 8 PRIOR ART
FIG. 8 shows an assembled conventional showcase wheels and aluminum rails.
Figure 9:
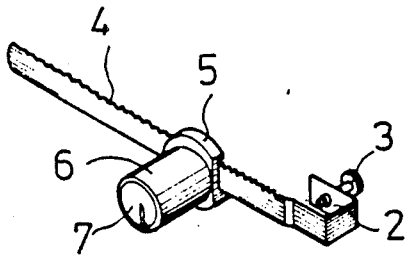
FIG. 9 PRIOR ART
FIG. 9 shows a conventional saw-toothed lock usually used on a showcases glass.
Figure 10:
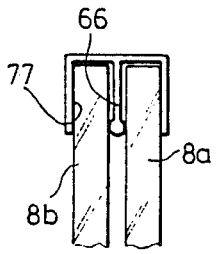
FIG. 10 PRIOR ART
FIG. 10 is a side view of a conventional upper channel used for a showcase.

Please further refer to FIGS. 1, 2, 3(A), 3(B), 4(A), and 4(B), which illustrate the assembly of the lower rail 50 and the lower sliding mechanism 10 which further including the wheels 71 and wheel lock 30 of the present invention, and show the locking and unlocking conditions thereof. When a key is inserted into the key hole 311' to rotate the rotary section 32 and push the same inward, a locking condition indicated by FIGS. 3(A) and 4(A) is formed, wherein the rotary section 32 is located in the lower groove 13 of the lower sliding mechanism 10 with the stop section 33 opposite against the glass 8a. To unlock the assembly, one only needs to rotate the key and pull the rotary section 32 and stop section 33 outward to form an unlocking condition which allows movement as indicated by FIGS. 3(B) and 4(B). Because the wheel lock 30 is firmly constructed, therefore, no slant due to vibration will occur. Please refer now to FIG. 5, the upper rail 70 of the present invention has a substantially M-shaped cross section, wherein two channels 71 and 72 are formed at each side of a middle recess 73. An upper sliding mechanism composed of two n-shaped insert channels 74 are respectively disposed in the channels 71 and 72 for fitly receiving upper edges of two glass 8a and 8b respectively. Wheels 75 are set on upper face 177 of the insert channel 74 in such a manner that wheel rim of the wheels 75 just contacts inner wall surface of the channels 71 and 72 and can freely roll thereon, as shown in FIGS. 6 and 7. Moreover, the wheels 75 are arranged in such a manner as to interchangedly contact left inner wall surface and right inner wall surface of each channel, so that the glass sheets 8a and 8b can be pulled or pushed with better stability. In addition, a plastic n-shaped member 76 is disposed between the insert channel 74 and the upper edge of the glass sheet 8a as shown in FIG. 6, to allow the glass sheet 8a to be more closely associated with the insert channel 74 whereby no swing and noise will occur during pulling or pushing the glass sheet.

It is to be understood that many of the details herein given may be varied considerably by those skilled in the art without departing from the spirit and scope of the present invention.

I claim:

1. Upper and lower sliding mechanisms for showcases, in which a glass sheet is disposed between the upper and lower sliding mechanisms, said upper and lower sliding mechanisms being received in an upper rail and a lower rail of the showcase respectively, wherein: said lower sliding mechanism comprises:

a horizontal middle portion to divide said lower sliding mechanism into an upper groove and a lower groove, said upper groove having a plurality of projections to form a plurality of recesses on inner wall surfaces, said lower groove having a pair of inwardly extending flanges formed at lower ends of side walls;

a plastic member having a plurality of projections formed on outer wall surfaces being inserted into said upper groove to receive said glass sheet, said projections of said plastic member engaging with said recesses of said upper groove;

a cover member engaging with said upper and lower groove, said cover member having a plurality of projections to engage with said recesses of said upper groove;

a plurality of wheels being rotatably engaged in said lower groove so that said lower sliding mechanism together with said glass sheet slide on said lower rail; and a lock disposed in said lower groove having a removable shaft which is composed of a rotary portion and a stop section, said shaft horizontally passing through said lower groove, when engaged, said stop section projecting out of said lower groove in order to prevent another glass sheet passing thereby; and said upper sliding mechanism comprises:

a n-shaped channel having a n-shaped plastic member disposed therein to receive upper end of said glass sheet in said n-shaped plastic member; and a plurality of wheels being engaged on upper surface of said n-shaped channel; thereby, said upper rail has a M-shaped crosssection to receive a pair of upper sliding mechanisms together with glass sheets and allow said upper sliding mechanisms to smoothly slide therein.

* * * * *